US011492861B2

(12) United States Patent
Eldho et al.

(10) Patent No.: US 11,492,861 B2
(45) Date of Patent: Nov. 8, 2022

(54) PACKER ASSEMBLY FOR USE WITHIN A BOREHOLE

(71) Applicant: Halliburton Energy Services, Inc, Houston, TX (US)

(72) Inventors: Shanu Thottungal Eldho, Singapore (SG); Vaishnavi Ganesh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 141 days.

(21) Appl. No.: 17/078,780

(22) Filed: Oct. 23, 2020

(65) Prior Publication Data

US 2022/0127918 A1 Apr. 28, 2022

(51) Int. Cl.
*E21B 23/06* (2006.01)
*E21B 33/12* (2006.01)

(52) U.S. Cl.
CPC ..... *E21B 23/06* (2013.01); *E21B 33/12* (2013.01)

(58) Field of Classification Search
CPC ..... E21B 23/06; E21B 33/12
See application file for complete search history.

(56) References Cited

U.S. PATENT DOCUMENTS 5,698,799 A * 12/1997 Lee, Jr. ..... E21B 33/1243 175/21
6,253,856 B1 7/2001 Ingram
10,961,807 B2 * 3/2021 Foster ..... E21B 33/12
2002/0011333 A1 * 1/2002 Ward ..... E21B 49/008 166/250.15
2019/0153852 A1 * 5/2019 Lallemand ..... E21B 47/12

FOREIGN PATENT DOCUMENTS

WO 2008063979 A1 5/2008
WO 2016094753 A1 6/2016

* cited by examiner

*Primary Examiner* — Steven A MacDonald
(74) *Attorney, Agent, or Firm* — K&L Gates LLP

(57) ABSTRACT

A packer assembly for use within a borehole. The packer assembly may include a mandrel, a top packer retainer, a packer, a bottom packer retainer, and a sleeve. The top packer may extend circumferentially around the mandrel. The packer may extend circumferentially around the mandrel and may be positioned downhole of the top packer retainer. The bottom packer retainer may extend circumferentially around the mandrel and may be positioned downhole of the top packer retainer. The bottom packer retainer may be shiftable to compress the packer against the top packer retainer to expand and set the packer. The packer sleeve may be shiftable between a run-in position covering the packer and a retracted position uphole of the packer, and the packer sleeve may restrict the packer from expanding when in the run-in position.

18 Claims, 2 Drawing Sheets

PACKER ASSEMBLY FOR USE WITHIN A BOREHOLE

BACKGROUND

This section is intended to provide relevant background information to facilitate a better understanding of the various aspects of the described embodiments. Accordingly, it should be understood that these statements are to be read in this light and not as admissions of prior art.

In the drilling and completion of oil and gas wells, a borehole is drilled into subterranean producing formations. The borehole is sometimes lined with casing to strengthen the sides of the borehole and isolate the interior of the casing from the surrounding formation. It may also be desirable to selectively seal or plug the well at various locations during the production of hydrocarbons (e.g., oil and/or gas) from a well. To do so, some completion procedures use packers, or similar devices, to provide hydraulic isolation of zones within the well for sequential operations in one zone while isolating already treated zones. For example, open-hole packers can be used to provide a seal in annular areas between concentric tubulars, such as the annular space between the earthen sidewall of the borehole and a tubular. Similarly, cased hole packers can be used to provide an annular seal between an outer tubular (such as the borehole casing) and an internal tubular (such as production tubing).

One common type of packer is a mechanical-set packer, which comprises a tool that compresses and expands a sealing material radially outward. For example, the sealing material may be constructed of a rubber compound or other suitable compressible material. Once the mechanical set packer reaches the desired location within the borehole, the packer is compressed to create a seal the in the annular area between concentric tubulars.

BRIEF DESCRIPTION OF THE DRAWINGS

Embodiments of the packer assembly are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a packer assembly for use in a borehole. The packer assembly includes a packer sleeve to prevent damage to the packer as it travels downhole.

A borehole may in some instances be formed in a vertical orientation relative to the earth's surface, and a lateral borehole may in some instances be formed in a substantially horizontal orientation relative to the earth's surface. However, the orientation of each of these boreholes may include portions that are vertical, non-vertical, horizontal, or non-horizontal. Further, the term "uphole" refers a direction that is towards the earth's surface, while the term "downhole" refers a direction that is further into the earth's surface.

Figure 1:
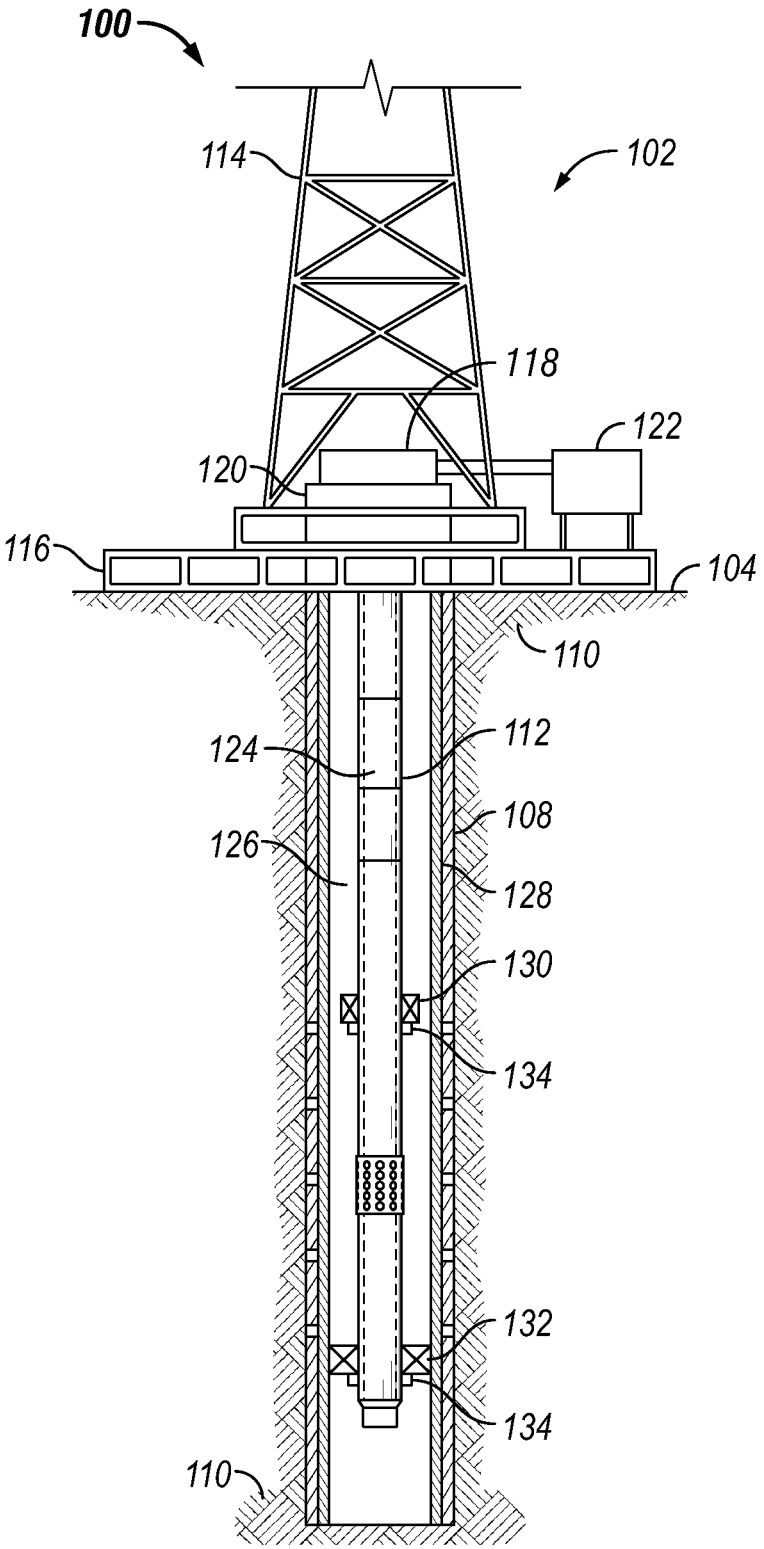
FIG. 1 is a schematic view of a well system, according to one or more embodiments.

FIG. 1 is a schematic view of a well system 100, according to one or more embodiments. The well system includes a rig 102 atop a surface 104 of a well 106. Beneath the rig 102, a wellbore 108 is formed within a geological formation 110, which is expected to produce hydrocarbons. The wellbore 108 may be formed in the geological formation 110 using a drill string that includes a drill bit to remove material from the geological formation 110. The wellbore 108 of FIG. 1 is shown as being vertical, but may be formed at any suitable angle to reach a hydrocarbon-rich portion of the geological formation 110. In some embodiments, the wellbore 108 may follow a vertical path, an angled path, a horizontal path, or any combination thereof through the geological formation 110.

A production tool string 112 is deployed from the rig 102, which may be a drilling rig, a completion rig, a workover rig, or another type of rig. The rig 102 includes a derrick 114 and a rig floor 116. The production tool string 112 extends downward through the rig floor 116, through a fluid diverter 118 and blowout preventer 120 that provide a fluidly sealed interface between the wellbore 108 and external environment, and into the wellbore 108 and geological formation 110. The production tool string is shown in installed position in FIG. 1. However, prior to or following installation, the production system 100 may also include a motorized winch and other equipment for extending the production tool string 112 into the wellbore 108, retrieving the production tool string 112 from the wellbore 108, positioning the production tool string 112 at a selected depth within the wellbore 108, or for lowering diagnostic, repair, or other equipment into the production tool string 112 by (for example) wireline or slickline.

A pump 122 is coupled to the fluid diverter. The pump 122 is operational to deliver or receive fluid through a fluid bore 124 of the production tool string 112 by applying a positive or negative pressure to the fluid bore 124. As referenced herein, the fluid bore 124 is the flow path of fluid from an inlet of the production tool string 112 to the surface 104. The pump 122 may also deliver positive or negative pressure through an annulus 126 formed between the wall of the wellbore 108 and exterior of the production tool string 112. The annulus 126 is formed between the production tool string 112 and a wellbore casing 128 when production tool string 112 is disposed within the wellbore 108. As referenced herein, the term "casing" may be used interchangeably with the term "liner" to indicate tubing that is used to line or otherwise provide a barrier along a wellbore wall. Such casings may be fabricated from composites, metals, plastics, or any other suitable material.

Following formation of the wellbore 108, the production tool string 112 may be equipped with tools and deployed within the wellbore 108 to prepare, operate, or maintain the well 106. Specifically, the production tool string 112 may incorporate tools that are actuated after deployment in the wellbore 108, including without limitation bridge plugs, composite plugs, cement retainers, high expansion gauge hangers, straddles, or packers. Any components of the production tool string that requires elements for sealing may benefit from use of the concepts of the present invention. As such, any elements that expand and form a seal can use sacrificial members as described herein. Actuation of such tools may result in centering the production tool string 112 within the wellbore 108, anchoring the production tool string 112, isolating a segment or zone of the wellbore 108 from other segments or zones, or other functions related to positioning and operating the production tool string 112. In the illustrative embodiment shown in FIG. 1, the production tool string 112 is depicted with packer assemblies 130, 132 that are actuated by actuation assemblies 134 for isolating segments of the wellbore 108. The actuation assemblies 134 utilize hydraulic pressure or mechanical force to compress and radially expand the packers 130, 132. Packers 130, 132 are typically used to prepare the wellbore 108 for hydrocarbon production (e.g., fracturing) or for service during formation (e.g., acidizing or cement squeezing). In FIG. 1, an upper packer assembly 130 is shown in run-in position and the lower packer assembly 132 is shown in an expanded position to form a seal against the wall of the wellbore 108 and the production tool string 112 to prevent fluids from regions in the formation 110 below the packer assembly 130, 132 from interacting with the production tool string 112.

Figure 2:
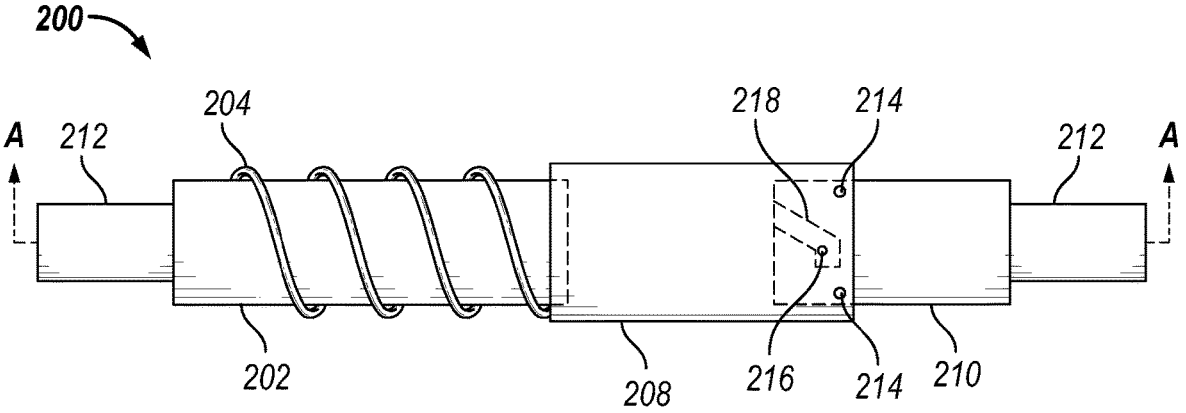
FIG. 2 is a top view of a packer assembly in a run-in position, according to one or more embodiments.
Figure 3:
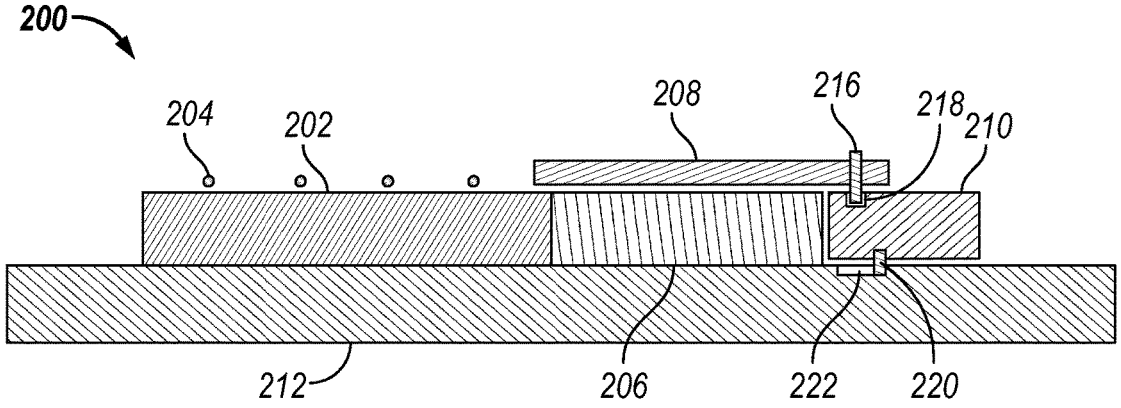
FIG. 3 is a partial cross-sectional view of the packer assembly of FIG. 2.

FIGS. 2 and 3 are a top view and a partial cross-sectional view along line AA of a packer assembly 200 in a run-in position, respectively, according to one or more embodiments. The packer assembly includes a top packer retainer 202, a tension device 204, a packer 206 (seem more clearly in FIG. 3), a packer sleeve 208, and a bottom packer retainer 210 positioned downhole of the top packer retainer 202. The top packer retainer 202, a tension device 204, the packer 206, the packer sleeve 208, and the bottom packer retainer 210 are all positioned circumferentially about a mandrel 212. The top packer retainer 202 is further coupled to the mandrel and the bottom packer retainer 210 is held axially in place on the mandrel 212 by an actuation assembly. The mandrel 212, in turn, may be positioned circumferentially about a tubular, such as a tool string, or the tool string may serve as the mandrel 212.

The packer sleeve 208 covers the packer 206 when the packer assembly 200 is in the run-in position, reducing or preventing damage to the packer 206 as the packer assembly 200 travels downhole. In at least one embodiment, as shown in FIG. 3, the packer sleeve 208 is also rounded and/or blade-shaped to promote a laminar flow around the packer sleeve 208 as it travels downhole. This is done to reduce the force on the packer sleeve 208 as it travels downhole. The packer sleeve 208 is retained in the run-in position by shear pins 214 that extend from the packer sleeve to the top packer retainer 202 and/or the bottom packer retainer 210 to couple the packer sleeve 208 to the top packer retainer 202 and/or the bottom packer retainer 210.

When the packer sleeve 208 is positioned in the run-in position, as shown in FIGS. 2 and 3, the tension device 204 exerts a biasing force that biases the packer sleeve 208 towards the top packer retainer 202. In the exemplary embodiment, the tension device 204 is a spring. In other embodiments, the tension device may be a piston assembly or any other type of device suitable for exerting a biasing force on the packer sleeve 208.

The packer sleeve 208 is also retained in the run-in position by a first guide pin 216 that extends from the packer sleeve 208 into a groove 218 formed in the bottom packer retainer 210. In another embodiment, the guide pin may extend from the bottom packer retainer 210 to a groove (not shown) formed in the packer sleeve 208. Regardless of the location of the groove 218, the groove 218 is shaped such that relative rotation between the packer sleeve 208 and the bottom packer retainer 210 releases the first guide pin 216 and allows the packer sleeve 208 to travel towards the top packer retainer 202.

As shown in FIG. 3, a second guide pin 220 extends from the bottom packer retainer 210 into a groove 222 formed in the mandrel 212. In another embodiment, the second guide pin may extend from the mandrel 212 into a groove (not shown) formed in the bottom packer retainer 210. Regardless of the location of the groove 222, the groove 222 is shaped to rotate the bottom packer retainer 210 a sufficient amount to release the first guide pin 216 from the groove 218 as the bottom packer retainer 210 is shifted towards the top packer retainer, as described in more detail below. The groove 222 also limits further rotation of the bottom packer retainer 210 once the guide pin 216 has been released.

Figure 4:
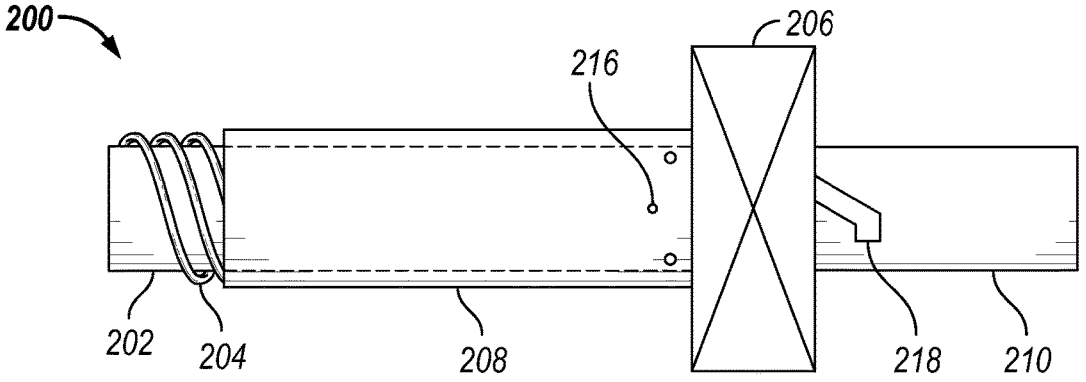
FIG. 4 is a top view of the packer assembly of FIGS. 2 and 3 in an expanded position.

Turning now to FIG. 4, FIG. 4 is a top view of the packer assembly 200 of FIGS. 2 and 3 in an expanded position. In order to expand the packer assembly 200 as shown in FIG. 4, an actuation assembly, such as the actuation assembly 134 described above with reference to FIG. 1, shifts the bottom packer retainer 210 towards the top packer retainer 202. In at least one embodiment, the shear pins 214 are sheared when sufficient force is applied by the bottom packer retainer 210 when the bottom packer retainer is shifted towards the top packer retainer 202 In other embodiments, the shear pins 214 may be formed from a dissolvable material and dissolve over time within the borehole. As the bottom packer retainer 210 shifts towards the top packer retainer 202, the bottom packer retainer 210 rotates, as described above, which releases the first guide pin 216 from the groove 218.

Once the shear pins 214 are sheared and the first guide pin 216 is released from the groove 218, the biasing force exerted by the tension device 204 shifts the packer sleeve 208 towards the top packer retainer 202, uncovering the packer 206. Once the packer sleeve 208 is in the retracted position uphole of the packer, continued shifting of the bottom packer retainer 210 towards the top packer retainer compresses and radially expands the packer 206 to set the packer 206 as described above with reference to FIG. 1.

Further examples include:

Example 1 is a packer assembly for use within a borehole. The packer assembly includes a mandrel, a top packer retainer, a packer, a bottom packer retainer, and a sleeve. The top packer extends circumferentially around the mandrel. The packer extends circumferentially around the mandrel and is positioned downhole of the top packer retainer. The bottom packer retainer extends circumferentially around the mandrel and is positioned downhole of the top packer retainer. The bottom packer retainer is shiftable to compress the packer against the top packer retainer to expand and set the packer. The packer sleeve is shiftable between a run-in position covering the packer and a retracted position uphole of the packer, and the packer sleeve restricts the packer from expanding when in the run-in position.

In Example 2, the embodiments of any preceding paragraph or combination thereof further include a first guide pin extending between the packer sleeve and the bottom packer retainer to retain the packer sleeve in the run-in position.

In Example 3, the embodiments of any preceding paragraph or combination thereof further include a second guide pin extending from the bottom packer retainer into a groove in the mandrel shaped to rotate the bottom packer retainer as it is shifted towards the top packer retainer to release the packer sleeve.

In Example 4, the embodiments of any preceding paragraph or combination thereof further include a shear pin positioned to retain the packer sleeve in the run-in position.

In Example 5, the embodiments of any preceding paragraph or combination thereof further include a tension device coupled to the packer sleeve that is configured to shift the packer sleeve towards the retracted position when the shear pin is sheared.

In Example 6, the embodiments of any preceding paragraph or combination thereof further include wherein the shear pin comprises a dissolvable material.

In Example 7, the embodiments of any preceding paragraph or combination thereof further include wherein the packer sleeve is shaped to promote a laminar flow around the packer sleeve as the packer assembly travels downhole.

Example 8 is a tool string for use within a borehole. The tool string includes a packer assembly and an actuation assembly. The packer assembly includes a mandrel, a top packer retainer, a packer, a bottom packer retainer, and a sleeve. The top packer extends circumferentially around the mandrel. The packer extends circumferentially around the mandrel and is positioned downhole of the top packer retainer. The bottom packer retainer extends circumferentially around the mandrel and is positioned downhole of the top packer retainer. The bottom packer retainer is shiftable to compress the packer against the top packer retainer to expand and set the packer. The packer sleeve is shiftable between a run-in position covering the packer and a retracted position uphole of the packer, and the packer sleeve restricts the packer from expanding when in the run-in position. The actuation assembly is operable to shift the bottom packer retainer to compress the packer against the top packer retainer and expand the packer.

In Example 9, the embodiments of any preceding paragraph or combination thereof further include wherein the packer assembly further comprises a first guide pin extending between the packer sleeve and the bottom packer retainer to retain the packer sleeve in the run-in position.

In Example 10, the embodiments of any preceding paragraph or combination thereof further include wherein the packer assembly further comprises a second guide pin extending from the bottom packer retainer into a groove in the mandrel shaped to rotate the bottom packer retainer as it is shifted towards the top packer retainer to release the packer sleeve.

In Example 11, the embodiments of any preceding paragraph or combination thereof further include wherein the packer assembly further comprises a shear pin positioned to retain the packer sleeve in the run-in position.

In Example 12, the embodiments of any preceding paragraph or combination thereof further include wherein the packer assembly further comprises a tension device coupled to the packer sleeve that is configured to shift the packer sleeve towards the retracted position when the shear pin is sheared.

In Example 13, the embodiments of any preceding paragraph or combination thereof further include wherein the shear pin comprises a dissolvable material.

In Example 14, the embodiments of any preceding paragraph or combination thereof further include wherein the packer sleeve is shaped to promote a laminar flow around the packer sleeve as the packer assembly travels downhole.

In Example 15, the embodiments of any preceding paragraph or combination thereof further include wherein the actuation assembly is operable to shift the bottom packer retainer via hydraulic pressure or mechanical force.

Example 16 is a method for deploying a packer assembly within a borehole. The method includes running the packer assembly set in a run-in position into the borehole, the packer assembly including a packer sleeve covering a packer to maintain the packer in the run-in position. The method also includes moving a bottom packer retainer towards a top packer retainer to release the packer sleeve and allow the packer sleeve to shift to a retracted position uphole of the packer. The method further includes continuing to move the bottom packer retainer to compress the packer between the top packer retainer and the bottom packer retainer to expand the packer.

In Example 17, the embodiments of any preceding paragraph or combination thereof further include retaining the packer sleeve in the run-in position with a shear pin that extends between the packer sleeve and the bottom packer retainer and shifting the bottom packer retainer to shear the shear pin and release the packer sleeve.

In Example 18, the embodiments of any preceding paragraph or combination thereof further include biasing the packer sleeve via a tension device coupled to the packer sleeve such that the packer sleeve shifts towards the top packer retainer when the shear pin is sheared.

In Example 19, the embodiments of any preceding paragraph or combination thereof further include comprising rotating the bottom packer retainer to release the packer sleeve from the run-in position.

In Example 20, the embodiments of any preceding paragraph or combination thereof further include wherein a guide pin extending from the bottom packer retainer into a groove in a mandrel of the packer assembly causes the bottom packer retainer to rotate when shifting towards the top packer retainer.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A packer assembly for use within a borehole, the packer assembly comprising:

a mandrel;

a top packer retainer extending circumferentially around the mandrel;

a packer extending circumferentially around the mandrel and positioned downhole of the top packer retainer;

a bottom packer retainer extending circumferentially around the mandrel and positioned downhole of the top packer retainer, wherein the bottom packer retainer is shiftable to compress the packer against the top packer retainer to expand and set the packer;

a packer sleeve shiftable between a run-in position covering the packer and a retracted position uphole of the packer, wherein the packer sleeve restricts the packer from expanding when in the run-in position; and a first guide pin extending between the packer sleeve and the bottom packer retainer to retain the packer sleeve in the run-in position.

2. The packer assembly of claim 1, further comprising a second guide pin extending from the bottom packer retainer into a groove in the mandrel shaped to rotate the bottom packer retainer as it is shifted towards the top packer retainer to release the packer sleeve.

3. The packer of claim 1, further comprising a shear pin positioned to retain the packer sleeve in the run-in position.

4. The packer assembly of claim 3, further comprising a tension device coupled to the packer sleeve that is configured to shift the packer sleeve towards the retracted position when the shear pin is sheared.

5. The packer assembly of claim 3, wherein the shear pin comprises a dissolvable material.

6. The packer assembly of claim 1, wherein the packer sleeve is shaped to promote a laminar flow around the packer sleeve as the packer assembly travels downhole.

7. A tool string for use within a borehole, the tool string comprising:

a packer assembly comprising:

a mandrel;

a top packer retainer extending circumferentially around the mandrel;

a packer extending circumferentially around the mandrel and positioned downhole of the top packer retainer;

a bottom packer retainer extending circumferentially around the mandrel and positioned downhole of the top packer retainer, wherein the bottom packer retainer is shiftable to compress the packer against the top packer retainer to expand and set the packer;

a packer sleeve shiftable between a run-in position covering the packer and a retracted position uphole of the packer, wherein the packer sleeve restricts the packer from expanding when in the run-in position; and a first guide pin extending between the packer sleeve and the bottom packer retainer to retain the packer sleeve in the run-in position; and an actuation assembly operable to shift the bottom packer retainer to compress the packer against the top packer retainer and expand the packer.

8. The tool string of claim 7, wherein the packer assembly further comprises a second guide pin extending from the bottom packer retainer into a groove in the mandrel shaped to rotate the bottom packer retainer as it is shifted towards the top packer retainer to release the packer sleeve.

9. The tool string of claim 7, wherein the packer assembly further comprises a shear pin positioned to retain the packer sleeve in the run-in position.

10. The tool string of claim 9, wherein the packer assembly further comprises a tension device coupled to the packer sleeve that is configured to shift the packer sleeve towards the retracted position when the shear pin is sheared.

11. The tool string of claim 9, wherein the shear pin comprises a dissolvable material.

12. The tool string of claim 7, wherein the packer sleeve is shaped to promote a laminar flow around the packer sleeve as the packer assembly travels downhole.

13. The tool string of claim 7, wherein the actuation assembly is operable to shift the bottom packer retainer via hydraulic pressure or mechanical force.

14. A method for deploying a packer assembly within a borehole, the method comprising:

running the packer assembly set in a run-in position into the borehole, the packer assembly comprising a packer sleeve covering a packer to maintain the packer in the run-in position;

moving a bottom packer retainer towards a top packer retainer to release the packer sleeve and allow the packer sleeve to shift to a retracted position uphole of the packer; and continuing to move the bottom packer retainer to compress the packer between the top packer retainer and the bottom packer retainer to expand the packer.

15. The method of claim 14, further comprising retaining the packer sleeve in the run-in position with a shear pin that extends between the packer sleeve and the bottom packer retainer and shifting the bottom packer retainer to shear the shear pin and release the packer sleeve.

16. The method of claim 15, further comprising biasing the packer sleeve via a tension device coupled to the packer sleeve such that the packer sleeve shifts towards the top packer retainer when the shear pin is sheared.

17. The method of claim 14, further comprising rotating the bottom packer retainer to release the packer sleeve from the run-in position.

18. The method of claim 17, wherein a guide pin extending from the bottom packer retainer into a groove in a mandrel of the packer assembly causes the bottom packer retainer to rotate when shifting towards the top packer retainer.

* * * * *